US005607351A

United States Patent [19]

Schwartz

[11] Patent Number: 5,607,351

[45] Date of Patent: Mar. 4, 1997

[54] COIN COUNTING MACHINE

[75] Inventor: Andrew J. Schwartz, Chester Springs, Pa.

[73] Assignee: Automated Currency Instruments, Inc., Chester Springs, Pa.

[21] Appl. No.: 337,666

[22] Filed: Nov. 10, 1994

[51] Int. Cl.[6] ..... G07D 9/04

[52] U.S. Cl. ..... 453/32; 453/57

[58] Field of Search ..... 453/30, 31, 32, 453/33, 34, 57; 377/7

[56] References Cited

U.S. PATENT DOCUMENTS

| | | | |
|---|---|---|---|
| 902,067 | 10/1908 | Froberg | 453/34 |
| 4,098,280 | 7/1978 | Ristvedt et al. . | |
| 4,230,136 | 10/1980 | Heinrichs . | |
| 4,234,003 | 11/1980 | Ristvedt et al. . | |
| 4,360,034 | 11/1982 | Davila et al. . | |
| 4,444,212 | 4/1984 | Ristvedt et al. . | |
| 4,531,531 | 7/1985 | Johnson et al. . | |
| 4,543,969 | 10/1985 | Rassmussen . | |
| 4,549,561 | 10/1985 | Johnson et al. . | |
| 4,564,036 | 1/1986 | Ristvedt . | |
| 4,570,655 | 2/1986 | Raterman . | |
| 4,598,724 | 7/1986 | Boland | 194/100 |
| 4,731,043 | 3/1988 | Ristvedt et al. | 453/6 |
| 4,775,354 | 10/1988 | Rassmussen et al. | 453/3 |
| 4,798,558 | 1/1989 | Bellis | 453/32 |
| 4,921,463 | 5/1990 | Primdahl et al. | 453/3 |
| 4,964,495 | 10/1990 | Rassmussen | 194/344 |
| 4,966,570 | 10/1990 | Ristvedt et al. | 453/6 |
| 5,009,627 | 4/1991 | Rassmussen | 453/10 |
| 5,011,455 | 4/1991 | Rasmussen | 453/10 |
| 5,022,889 | 6/1991 | Ristvedt et al. | 453/6 |
| 5,026,320 | 6/1991 | Rassmussen | 453/6 |
| 5,141,443 | 8/1992 | Rasmussen et al. | 453/32 |

*Primary Examiner*—F. J. Bartuska

*Attorney, Agent, or Firm*—Craig M. Bell; Dann, Dorfman, Herrell and Skillman, P.C.

[57] ABSTRACT

A coin counting machine for the valuation of large, multi-denominational aggregations of coins is comprised of a rotating disk assembly that determines the coins value according to its size as it passes over a photoelectric unit. Large mixtures of coins are dumped into a cylindrical coin deposit tray that is centrally disposed upon two circular disks with grooves or passageways formed therebetween. The tray has a plurality of equidistantly spaced exit recesses in its walls that connect with the passageways. As a motor spins the disk assembly, coins disposed within the bin are flung outwards through the recesses and along the passageways where a photoelectric sensor unit records the value of each coin according to its size and relays the information to a microprocessor control unit.

23 Claims, 5 Drawing Sheets

COIN COUNTING MACHINE

FIELD OF THE INVENTION

The present invention relates to coin and token counting machines for use in multi-denominational transactions requiring speed and accuracy.

BACKGROUND OF THE INVENTION

The task of counting, sorting and verifying the value of multi-denominational aggregations of coins is quite arduous in the day to day operation of those industries where coin handling is paramount such as banks, toll booth authorities and casinos. The problem that arises however, is that generally before most coins can be counted and the value of the amount determined, the coins must first be separated and sorted. Sorting is the most critical step in the coin handling processes known in the art and generally creates the highest percentage of service problems for the aforementioned industries among others. For example, if an incorrect sort occurs, i.e. the coin(s) are mis-sorted, the result is an inaccurate count and consequently an inaccurate valuation assigned to the aggregation.

Obviously, such inaccuracies produce accounting errors of inventory and currency exchanges with the respective institutions' customers whereby someone gets cheated. Additional problems arise if the customer, particularly in casino situations such as slot machine payouts, feels the value assigned is incorrect and wishes a recount or verification. In the machines known in the art and available in the industry, the coins have already been sorted and in most cases commingled with other aggregations. Any attempt to verify the value or re-count the coins requires an extremely difficult and time consuming procedure which shuts down the machine for quite some time.

Many devices exist in the art for sorting coins using a rotating disk type mechanism. Most employ a rotatable lower disk which has a stationary upper disk superimposed thereon with guides of various widths that sort coins according to their respective size, weight or diameter. U.S. Pat. No. 4,543,969 to Rasmussen discloses a coin sorter apparatus comprised of a rotating disk located proximate a stationary disk. The coins are moved between the two disks wherein a series of ridges and recesses sorts the mixed denomination of coins through peripherally located spaces that exit the coin, thereby sorting it according to its thickness. U.S. Pat. No. 4,775,354 also to Rasmussen sorts the coins in a similar fashion using a rotating disk assembly that separates them according to their diameter.

U.S. Pat. No. 4,570,655 to Raterman teaches a coin sorting apparatus similar to that of Rasmissen utilizing the rotating disk assembly with grooved surfaces for transporting coins in outward radial directions according to their size. Exit recesses equidistant from each other about the periphery of the disk provide a means to separate and sort the coins. A sensory device is located by each recess which, when a pre-determined number of coins are sorted, automatically signals a bridge guide and a diameter guide which redirect the rotating coins and terminate the sorting process for each respective denomination. U.S. Pat. No. 4,564,036 to Risvedt discloses a similar apparatus whereby sensors count coins separated according to size and when a predetermined number is sorted the remaining coins are redirected back to the center of the disk.

U.S. Pat. No. 4,921,463 to Primdahl et. al. discloses a rotating disk assembly wherein the coins are sorted as they are ejected through equidistantly-spaced recesses in the periphery of the lower disk which are counted by a sensor. Once a predetermined number is reached, a brake mechanism is operatively connected to the sensor through an electromagnetic actuating assembly and shuts the sorting process off when that number of coins is sorted.

U.S. Pat. No. 4,098,280 and 4,444,212 both to Risvedt et. al. disclose rotating disk assemblies with a flexible surface and an annular guide plate suspension thereon to direct radially moving coins towards the periphery. Counters calibrated to the denomination at each exit allow for the determination of the number of coins of each denomination. U.S. Pat. Nos. 4,531,531 and 4,549,561 to Johnson et. al. discloses a coin sorting apparatus comprising a rotating disk which, like the rest of the prior art, separates the coins using grooves and recesses which direct the coins in their radial movement outward due to centrifugal force to designated exit portals which sort them according to size. Coin counters may be of the type employing light, radiation, magnetic or other forms of conventional sensing devices to verify each different sized coin. The coins move single file about the periphery until each one exits through an appropriately sized recess.

None of the cited prior art however teaches or suggests the continuous operation of the counter/sorter which just counts the coin and tabulates its value according to its denomination and then sorts. Moreover, none of the prior art provides a device which counts and then returns all of the counted coins to their original mixed denominational state where their value can be recounted accurately and quickly in order to resolve any disputes that may arise regarding the final value.

It would therefore be advantageous to provide a machine that could count vast volumes of multi-denominational coins in a fast and reliable manner prior to sorting in order to allow for a quick and easy verification if necessary. More specifically, it is an object of the present invention to provide a means for the sorting of coins or tokens that are aggregated in a mixed-multi-denominational state at a high rate of speed and accuracy without regard to sorting. The customer or owner of the aggregation of coins will then have the option to accept the stated value as true or demand a recount and/or verification which is easily achieved by retrieval of the still unsorted, mixed aggregation of coins which have been collected after counting into existing money bags.

SUMMARY OF THE INVENTION

The present invention is a digitally controlled coin/token counting system that permits the fast and accurate valuation of a mixed aggregate of multi-denominational coins. A rotating disk containing integral radial guides centrifugally moves the coins from a centrally located coin deposit tray outward until the coins are flung uncontrollably off the disk and downward into a temporary storage bin. The value of the coin is determined by an electronic sensor disposed within the guide that relays this information to a microprocessor-based programmable logic controller which records and qualifies the coins passing thereto. After completing the count of a given batch, the coins may be returned to the customer if the determined value is challenged or can be sorted and accounted for as a complete transaction.

DETAILED DESCRIPTION OF THE INVENTION

Figure 1:
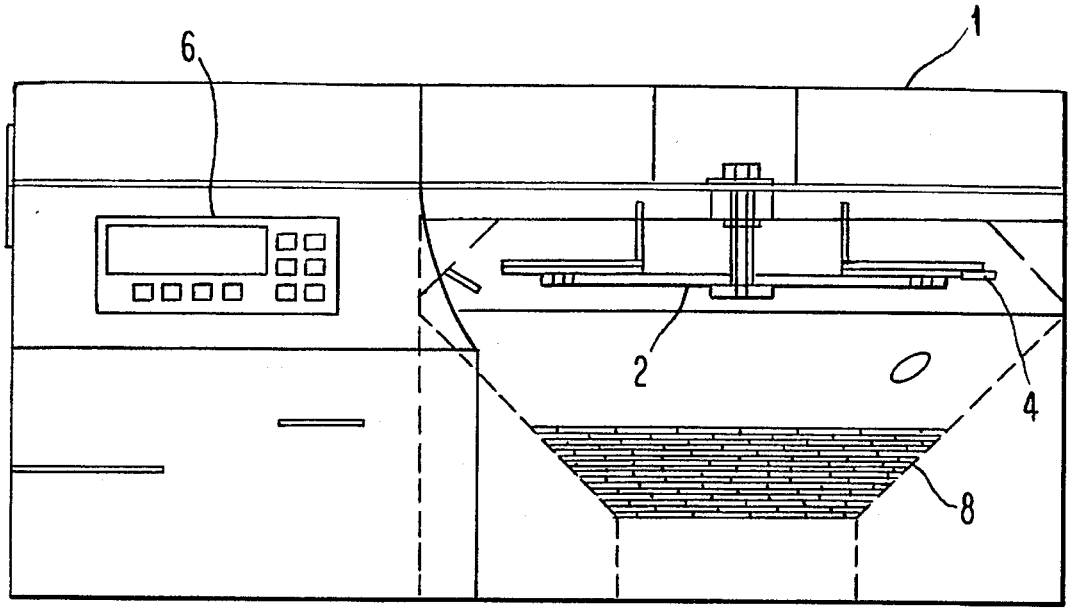
FIG. 1 is an overall side view of the coin counting machine of the present invention showing a cross-sectional view of the rotating disk assembly.

The coin counting apparatus of the present invention enables one to quickly count and value a mixed assortment of coins or tokens prior to sorting and allows for an immediate and simple recount if necessary. In general, referring first to FIG. 1, the coin counting apparatus is comprised of a cabinet for containment of the component parts (1), a rotating disk assembly (2), an electronic sensor device operatively attached thereto (4), a microprocessor logic control unit (6) for assimilation and analysis of the data from the sensor and a deposit bin for eventual collection and storage of the counted coins (7). Each multi-denomination or single denominational aggregate of coins that is collected may be packaged and marked as to their value using a bar coding device (not shown) or can be returned to the counting device for verification if so desired.

Figure 2:
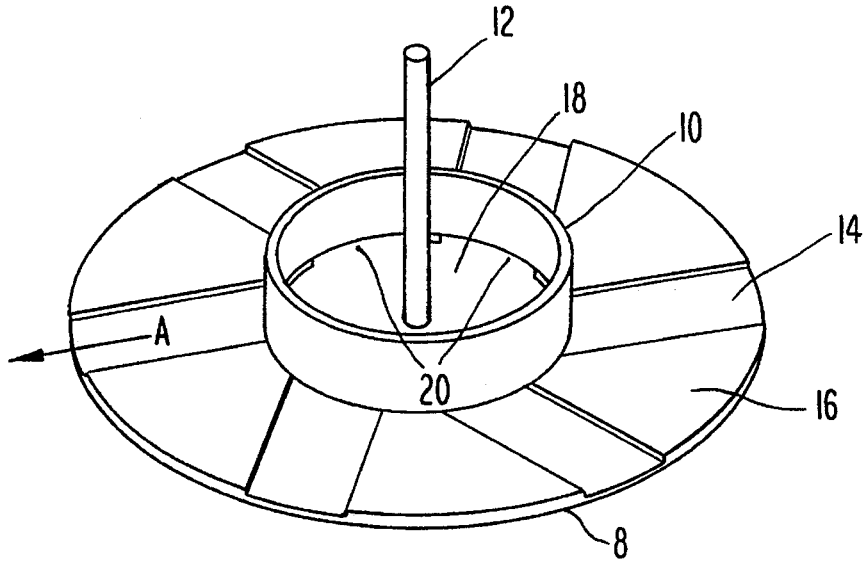
FIG. 2 is an overhead, isolated view of the grooved disk embodiment of the rotating disk assembly of the present invention.

The rotating disk assembly can be comprised of several different embodiments. Referring now to FIG. 2, the most simplistic design for the rotating disk assembly can consist of one lower disk (8) with a centrally disposed coin deposit tray (10) a motorized drive shaft (12) and equally spaced guides or channels (14) that are partially grooved or recessed into the upper surface of the disk (16) and are approximately two (2) inches wide and one-eighth (⅛) of an inch deep. What is important is that the equally spaced, equally sized grooves are large enough to accommodate the largest denomination of coined currency such as five dollar piece used in gaming establishments. The grooves (14) run from the periphery of the disk (8) under and into the space (18) formed within the coin deposit tray by means of contiguous portals (20) in the walls of the tray (10). The operation of a motor (not shown) operatively attached to the drive shaft (12) and positioned above the rotating disk assembly (2), rotates the disk and the coins are centrifugally forced out of the collection bin,(10) through the slots (20) in single file in an outward direction (arrow A) down the groove to be counted and valued by a sensor device (not shown).

In a similar fashion, the disk assembly can comprise a solid lower disk (8) with no grooves but with equally sized and spaced pie-shaped wedges (22) superimposed thereon. The wedges correspond to the top surface (16) of the integral disk in FIG. 2 and the placement of the wedges forms passageways or guides for the coins deposited in the coin collection tray to be moved radially outward through the application of centrifugal force by spinning the rotating disk assembly. In this embodiment, it is preferred that the outer edges of the wedges extend beyond that of the supporting disk (8) so that there is a space in which the coins can fall down after having spun past the edge of the lower disk. This is economically advantageous as the surrounding wall of the disk containment space can be flush against the edge of the wedge allowing for construction of the smallest possible volume for the entire mechanism. This saves space and money in terms of constructions costs.

Figure 3:
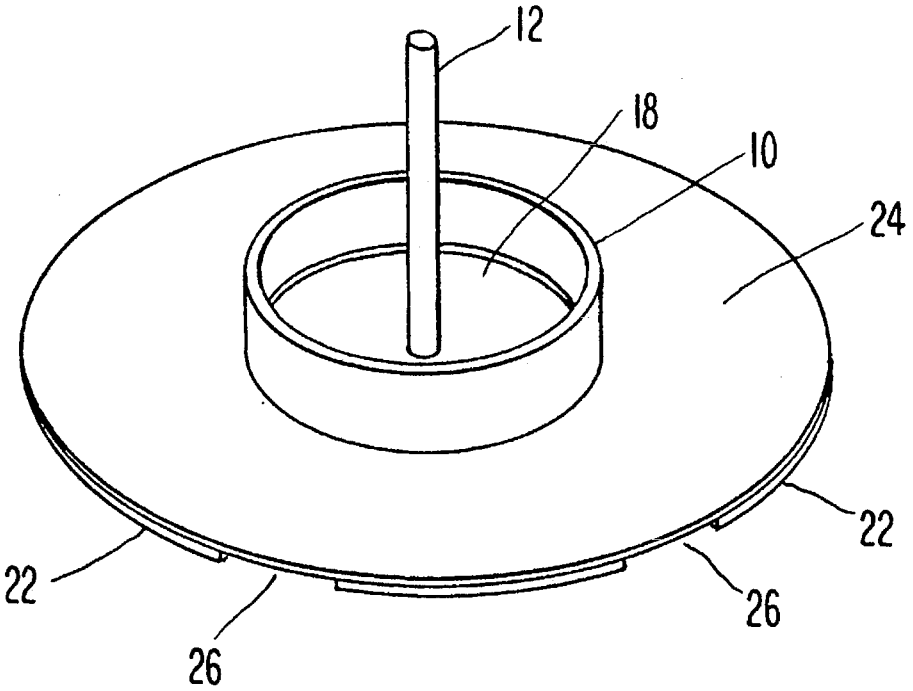
FIG. 3 is an overhead, isolated view of the intact wedge embodiment of the rotating disk assembly of the present invention.

Referring now to FIG. 3, the preferred embodiment of the present invention comprises a three-layered rotating disk assembly (2) consisting of a lower disk (8, not shown), a series of equally sized, equidistantly spaced wedges (22) overlapping the lower disks periphery and an upper disk (24) that extends beyond the periphery of the lower disk (8) and is contiguous with the peripheral edges of the wedges (22). The wedges (22) so placed form passageways or guides (26) that functionally correspond to the grooves (14) in FIG. 2 and connect the central area (18) of the coin deposit tray (10) with the outer perimeter of the disks. Again, since the wedges (22) and upper disk (24) extend beyond the periphery of the lower disk (8), coins that are spun outward by the centrifugal force of the rotating disk assembly can fall downward through the gap (26) formed thereby so as to allow the walls of the containment bin to be as close as possible to the periphery of the upper disk (24).

An alternative to this embodiment would be a two-layered disk assembly in which the wedges (22) are removed and the lower disk is grooved as in FIG. 2 so that the grooves provide the directional functionality served by the passageways (14) formed by the equally spaced wedges (22). A larger, upper disk (24) is then superimposed over the lower disk (8). In both cases, the size of the passageways or grooves is not of great importance but preferably should be about two (2) inches in width and one-eight (⅛) of an inch in depth so as to be able to disperse and register any sized coin up to a five dollar gaming piece.

Figure 4:
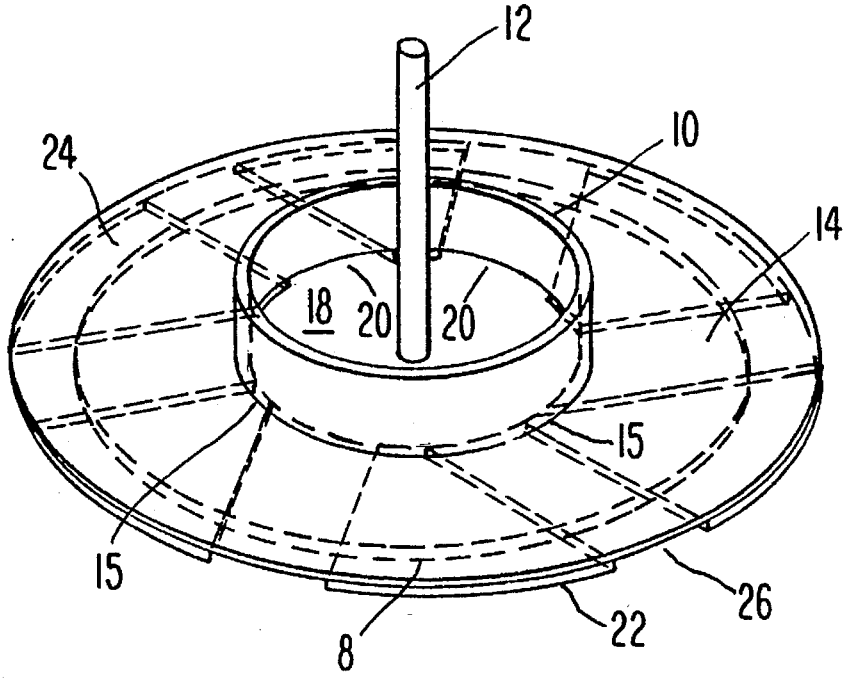
FIG. 4 is an isolated transparent view of the rotating disk assembly of the present invention.

Referring now to FIG. 4, the rotating disk assembly (2) of FIG. 3 is shown in phantom whereby the lower disk (8) and upper disk (24) are aligned so as to sandwich a number of the pie-shaped wedges (22) therebetween. The peripheral edge of the upper disk (24) is aligned with that of the pie-shaped wedges (22) and this extends over the circumference of the lower disk (8). The symmetrical arrangement of the wedges (22) about the periphery of the upper disk (24) and coin deposit tray (10) which is superimposed upon the wedges apices (15) provides channels or guides (14) through which the coins may pass when pushed outward by the centrifugal force created by the spinning motion of the rotating disk assembly (2).

As before in the embodiment wherein the pie-shaped wedges are arranged about the lower disk (8) without a top disk (24) placed thereon, the wedges (22) and the periphery of the upper disk (24) extend over beyond the circumference or periphery of the lower disk (8). This, as before, creates a gap (26) which results in the coins immediately falling down prior to reaching the far edges of the disk assembly (2) created by the circumference of the upper disk (24). This allows for the construction of containment walls (not shown) immediately proximate to the upper disk edge and maximizes space efficiency while lowering constructions costs.

There is no specific requirement as to the size of the disks themselves which would only depend on the size of the machine which in turn is dictated by space restrictions and the volume of coins to the counted. Generally, disks of one to two feet in diameter is sufficient.

Figure 5:
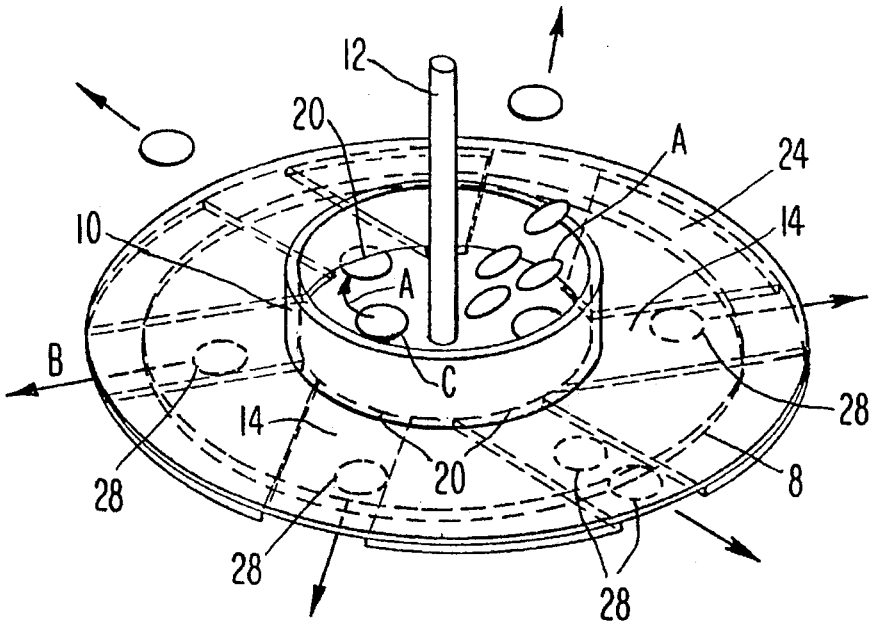
FIG. 5 is an isolated transparent view of the rotating disk assembly of the present invention showing disbursement of coins during operation.

Referring now to FIG. 5, the rotating disk assembly (2) is again shown in phantom with the coins (28) placed as they would be during a counting procedure. The coins (28) that are dumped into the coin feed tray (10) are urged outwards against the wall of the tray (arrow A) due to centrifugal forces exerted against them from the spinning motion of the disk assembly (2) when the motor (not shown) attached to the drive shaft (12) is turned on. The constant revolution of the disk (8,24) and deposit tray (10) continually move the coins about in the tray and result in the eventual placement of each coin at the entrance (22) to one of the grooves (14) of the lower disk (8). Continued exertion of the centrifugal forces brought about by the revolution of the disks push and channel the coins in an outward radially extending movement (Arrow B) to the outer periphery of the disks during which time they are detected by the sensor system (not shown), counted and expelled.

Figure 6:
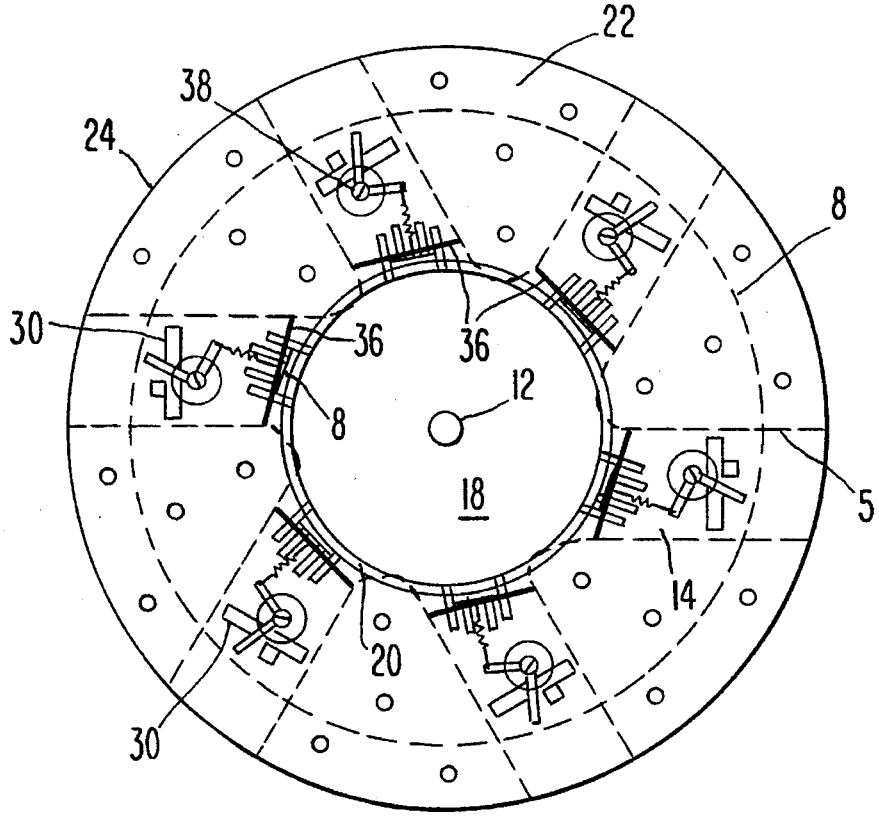
FIG. 6 is an overhead, cross-sectional view of the rotating disk assembly showing the sensor locations, wedges and jam clearing means.

Referring now to FIG. 6, the rotating disk assembly 2 of the preferred embodiment of the present invention (FIGS. 4 and 5) is viewed in greater detail showing the additional component parts. As stated previously, coins to be counted are initially placed within the centrally disposed coin deposit tray (10) which is connected at its base with either the radially extending grooves constructed within the top (16) of the lower disk (8) or as in this case passageways or guides (14) formed between the lateral edges of the pie-shaped wedges (22) so that upon rotation of the disk assembly (2), coins deposited in the feed tray (10) exit through the entrance (20) to the guides (14) and move in an outward radial direction through the passageways or grooves (14) due to the exertion of centrifugal forces resulting from the spinning of the disk assembly.

The grooved disk design with the definitive grooves or the symmetrically arranged wedges (22) which form the passageways (14) insures that the coins will move in a predetermined direction in a single file manner so that each coin will pass over a judicially placed sensor device (30) that is shown in phantom located in each of the grooves or passageways (14). Each sensor device is essentially a light sensitive phototransistor which detects the variance of a light source that is relative to a specific coin size. Suitable sensors are those such as Panasonic's Optoelectionic LED and transistor Digi-Key #F5F1QT-ND and #HZ1A1QT-ND manufactured by Pansonic Ltd. Tokyo, Japan. The sensor is calibrated with a microprocessor logic control unit known in the art (FIG. 1) located apart from the rotating disk assembly. This can be any of the personal computers available in the market. This programmable control consists of a miniature controller card with job specific programming capabilities such as the value of a coin according to its size. Such hardware is available through Z-World, Inc., Davis, Calif. As is known in the art, such sensors can be calibrated so as to detect a coins denomination through its diameter size, weight and the like. The information relaying the type of each coin which passes over the sensor is fed to the microprocessor which then records the type of coin counted, calculates its value and adds the totals. Such calculations can be made instantaneously with each passing coin so hundreds or even thousands of coins can be counted, valued and collected within a relatively short period of time. Pennies, nickels, dimes, quarters, half and silver dollars, gold dollars and gaming pieces used in the gambling industry can all be counted in this fashion. The microprocessor/sensor system could also be calibrated to count and value foreign currency as well. The (20) entrance to the guides (20) between the interior of the coin deposit tray (10) and the grooves or passageways (14) may also be adjustable and will be set so that in a given collection of coin denominations the coin to be counted with the largest diameter will pass through unencumbered. A strip of resilient material (36) such as polyethylene, natural or synthetic rubber may be positioned at the top of the inlet guide (20) across the lower surface of the upper disk (24) and a slight degree of drag is encountered by each coin entering the guide so that no "piggybacking" of coins can occur. In the embodiment set forth in FIG. 2 wherein the upper disk (24) is absent the resilient strip (36) may be located at the inlet guide (20) along the bottom edge of the coin collection box (10) If a coin or coins should happen to get jammed within this point of entry, spring-actuated clearing posts (38) are positioned at equally spaced intervals so that with each revolution of the disks, the entrance guide (20) is swept by one of the clearing posts (38) insuring that no coins will jam and clog any of the inlets thereby disrupting and slowing the counting process.

Figure 7:
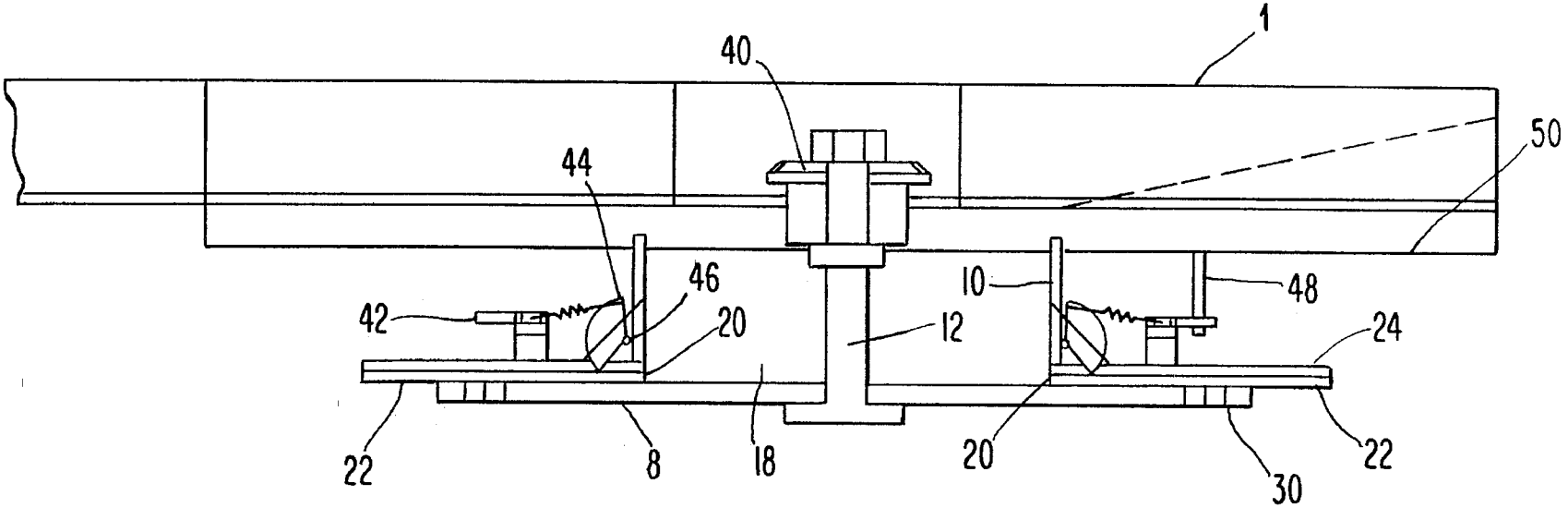
FIG. 7 is a cross-sectional side view of the rotating disk assembly of the present invention showing the sensors and jam clearing means.

Referring now to FIG. 7, a cross-sectional view of the rotating disk assembly (2) is shown in spatial relation with the top of the coin counting device (1) of the preferred embodiment of the present invention. Here again, the upper disk (24) is superimposed upon the pie-shaped wedges (22) and placed upon the circular lower disk (8) arranged so as to form passageways or grooves (14) therebetween about the centrally disposed drive shaft (12) circumferentially surrounded by the coin deposit tray (10). The coin feed tray (10) in this embodiment sits below the electric motor (40) that spins the disk assembly (2) and forces the coins outward (arrow A) through the slots formed by the contiguous connection (20) of the grooves or passageways (14) with the coin deposit tray.

The spring-actuated clearing posts (38) are shown positioned upon the upper surface of the upper disk (24). Upon operation of the machine, there are times when more than one coin may be centrifugally positioned and forced through the outlet openings of the coin deposit tray (20) connecting the grooves or passageway (14) with the interior (18) of the coin deposit tray (10). When this happens, jamming occurs and the outlets become clogged thereby preventing any coin from exiting at that point. A spring-actuated pivot arm (42) is operatively positioned against a hemispherically shaped sweeper means (44) which rotates about a pivot (46) in juxtaposition to the guide exit slot (20). As the disk assembly spins around, a fixed stationary bar (48) protruding downward from the ceiling of the containment wall (50) strikes the pivot arm (42) one time each revolution. Should any coins be jammed in the slot (20), upon striking the stationary bar (48) the spring actuated pivot arm (42) pushes against the hemispherically shaped sweeper means (44) which pushes inward through the exit slot (20). In this manner any coins jammed therein are pushed away thereby clearing the opening for other coins to exit.

As the coins travel down the grooves or passageway (14) formed by the pie-shaped wedges (22), they pass over the sensor (30) which digitally relays the coin size and hence monetary value to the microprocessor logic control (6) which tallies and values the coins counted. Rather than sorting the coins at this point, they all fall down into the coin collection bin (8) for temporary storage. If the value calculated is acceptable to the customer, the coins may be bagged and the value amount bar-coded and stamped thereon. In this manner each collection aggregation not returned to the customer may be tabulated and evaluated at a glance. There is no need for the extensive paper trail necessary by those machines known in the art. A bar code printer may be directly connected to the microprocessor logic control unit and immediately produce a bar code indicating the bags value after evaluation which is then attached to the bag for accounting control.

Figure 8:
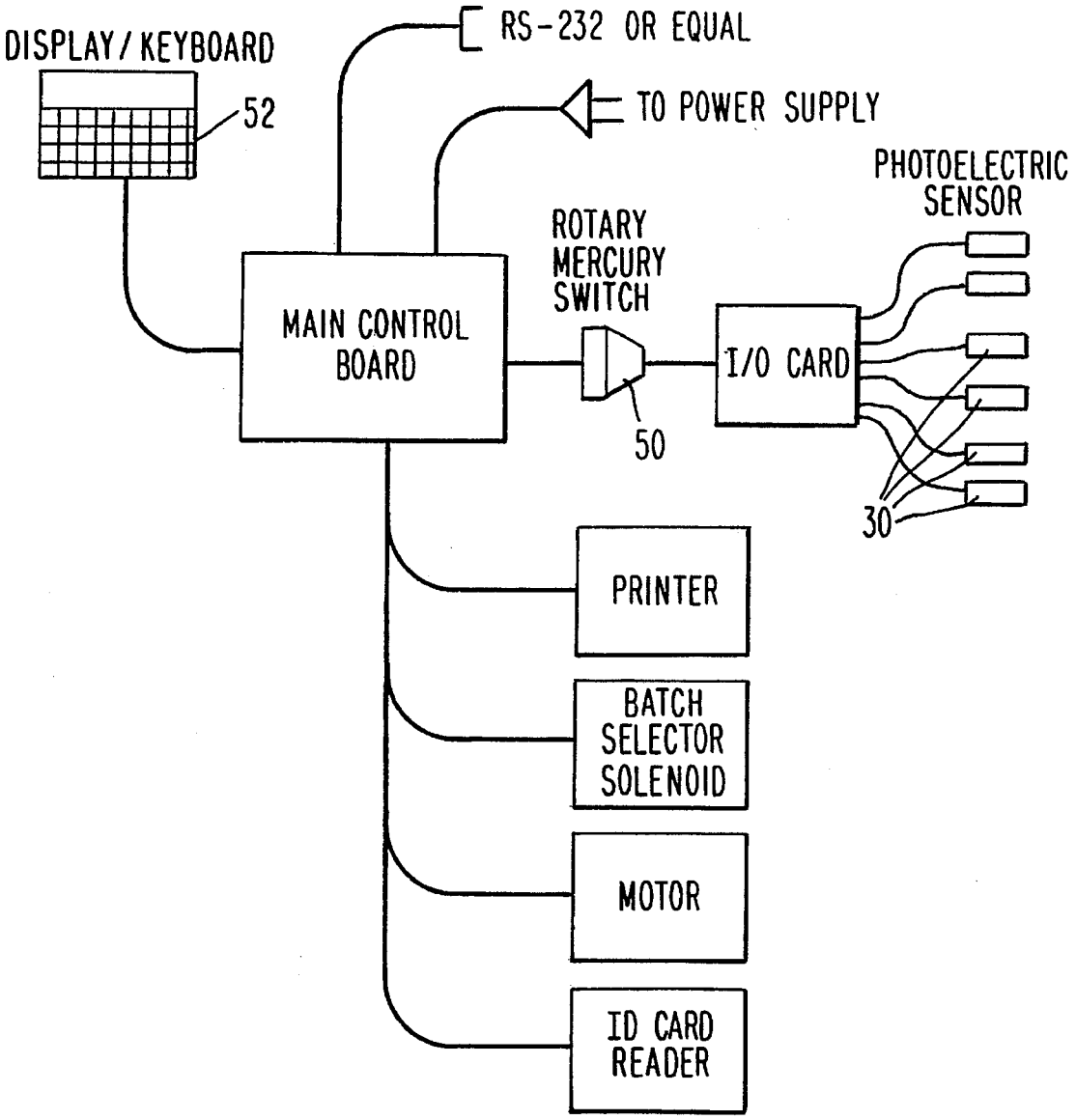
FIG. 8 is a schematic representation of the sensor counting system of the present invention.

FIG. 8 is a schematic representation of the entire photoelectric sensor system of the coin counting device of the present invention. Each individual photoelectric sensor (30) located within the respective grooves or passageways formed by the symmetrical arrangement of pie-shaped wedges (22) between the rotating disks are connected to the main control board (6) of the microprocessor unit by means of a rotary mercury switch (51). This allows for the continual spinning of the sensors (30) in a circular rotation without an entanglement of wires, connectors and the like. An LED display and keyboard (52) attached to the unit allows for the programming of what types of currency the sensors (30) will differentiate and count. Optionally, a printer (54) for the printing of the bar codes that state a respective aggrigatious value may be attached to the unit and operated as is known in the art.

What we claim is:

1. A means for receiving, counting and calculating the monetary value of a collection of mixed denominations of coins comprising:

a) a rotating disk assembly;

b) at least one electronic sensor operatively attached thereto that rotates with said disk;

c) a microprocessor logic control for receiving information from said sensor, and d) a collection bin for the temporary storage of said counted coins.

2. The means for receiving and counting coins of claim 1 wherein said rotating disk assembly comprises:

a) a centrally disposed drive shaft operatively connected to a motor;

b) a substantially cylindrical coin deposit tray for receiving said coins disposed about said drive shaft;

c) at least one rotating disk supporting said coin deposit tray for the centrifugal selection, guidance and removal of said coins, and d) at least one electronic sensor operatively attached to said disk that rotates with the disk for detection of the coins.

3. The coin counting means of claim 2 wherein said rotating disk comprises a plurality of passageways for guidance of said coins radially extending outward from its center connected to and in communication with the area within the coin deposit tray by exit recesses within the wall of said bin.

4. The coin counting means of claim 3 wherein said passageways are defined by grooves integrally cut into the upper surface of said rotating disk.

5. The coin counting means of claim 3 wherein said passageways are defined by a symmetric arrangement of pie-shaped wedges equidistantly spaced about the periphery of said lower rotating disk.

6. A means for receiving, counting and calculating the monetary value of a collection of mixed denominations of coins comprising:

a) a rotating disk assembly operatively attached to a centrally disposed drive shaft and motor wherein said disk assembly consists of a first lower disk a second upper disk superimposed thereon that connectively supports a substantially cylindrical coin deposit tray that leads to a symmetric, outwardly radiating arrangement of passageways between the disks, each containing an electronic sensor disposed therein for the centrifugal selection, counting and guidance of the coins to exit recesses as the disks rotate;

b) a microprocessor logic control for receiving information from said sensors, and c) a collection bin for the temporary storage of the counted coins.

7. The coin counting means of claim 6 wherein the periphery of said second upper rotating disk extends beyond that of said lower rotating disk.

8. The coin counting means of claim 7 wherein pie-shaped wedges are sandwiched between said upper and lower rotating disks.

9. The coin counting means of claim 8 wherein each passageway has at least one sensor operatively disposed therein.

10. The coin counting means of claim 9 wherein said sensor is a photoelectric unit.

11. The coin counting means of claim 10 whereby said photoelectric unit detects the size and/or mass of each coin that travels down the passageway and forwards said information to the microprocessor logic control.

12. The coin counting means of claim 11 wherein said rotating disk assembly further comprises a spring actuated clearing post proximate to the exit recesses of said coin deposit tray.

13. The coin counting means of claim 12 wherein the operation of said motor turns said drive shaft which rotates the disk assembly so that any coins, deposited in said coin deposit tray are forced outward through the exit recesses and along said plurality of passageways.

14. The coin counting means of claim 13 wherein said coins are counted, their monetary value calculated and the coins returned to said collection bin in the original, mixed denominational state.

15. A coin counting device for determining the value of an aggregate of mixed denominations of coins comprising:

a) a rotating disk assembly comprised of a number of pie-shaped wedges equidistantly arranged and sandwiched between an upper and a lower circular disk;

b) at least one electronic sensor operatively attached thereto;

c) a microprocessor logic control for receiving information from said sensor;

d) a collection bin for the temporary storage of said counted coins therefore.

16. The coin counting device of claim 15 wherein said rotating disk assembly furthers comprises a coin deposit tray centrally disposed upon said upper disk and in proximate contact with passageways formed by said pie-shaped wedges.

17. The coin counting device of claim 16 wherein said pie-shaped wedges of the integral disk are equidistantly arranged about the periphery of said disk so as to form grooves or channels radiating from the periphery of said coin deposit tray to the periphery of said upper disk.

18. The coin counting device of claim 17 wherein said rotating disk assembly further comprises a centrally disposed drive shaft operatively connected to a motor.

19. The coin collecting means of claim 18 wherein said drive shaft, when said motor is in operation, spins said rotating disk assembly thereby creating a centrifugal force which moves any coins deposited in said coin deposit tray radially outward through exit recesses formed within the wall of said tray and along the passageways formed by the arrangement of the pie-shaped wedges.

20. The coin collection device of claim 19 wherein said rotating disk assembly comprises a plurality of electronic sensors operatively placed within the passageways formed by said pie-shaped wedges.

21. The coin collection device of claim 20 wherein said electronic sensor is a photoelectric sensor.

22. The coin collection device of claim 21 wherein said channels are contiguous with the inside of said coin deposit tray thereby forming an inlet guide.

23. The coin collection means of claim 22 wherein said rotating disk assembly further comprises a spring actuated clearing post positioned proximate to each inlet guide for the removal of coins jammed therein.

* * * * *